US005342815A

United States Patent [19]

Sugiyama et al.

[11] Patent Number: 5,342,815

[45] Date of Patent: Aug. 30, 1994

[54] REVERSIBLE THERMOSENSITIVE RECORDING MATERIAL AND METHOD FOR PRODUCING THE SAME

[75] Inventors: Kunitoshi Sugiyama; Hideyuki Kobori; Shuji Hanai, all of Numazu; Tsutomu Kagawa, Shizuoka, all of Japan

[73] Assignee: Ricoh Company, Ltd., Tokyo, Japan

[21] Appl. No.: 111,557

[22] Filed: Aug. 25, 1993

[30] Foreign Application Priority Data

Aug. 26, 1992 [JP] Japan ..... 4-250705

[51] Int. Cl.[5] ..... B41M 5/26

[52] U.S. Cl. ..... 503/217; 503/201; 503/214; 503/225

[58] Field of Search ..... 503/201, 214, 217, 225, 503/226

[56] References Cited

U.S. PATENT DOCUMENTS 5,158,926 10/1992 Hotta et al. ..... 503/226

*Primary Examiner*—Pamela R. Schwartz

*Attorney, Agent, or Firm*—Oblon, Spivak, McClelland, Maier & Neustadt

[57] ABSTRACT

A reversible thermosensitive recording material composed of a support, and a reversible thermosensitive recording layer formed on the support, containing a matrix resin and an organic low-molecular-weight material, the organic low-molecular-weight material being dispersed in the form of discrete domains in the matrix resin, thereby constituting a phase-separation structure, with the periodic distance of the phase-separation structure of the reversible thermosensitive recording layer being 1.3 μm or less. This reversible thermosensitive recording material can be produced by applying a coating liquid containing the organic low-molecular-weight material and the matrix resin which are dissolved in a solvent to the support to form the reversible thermosensitive recording layer on the support; and drying the applied coating liquid under such conditions controlled so as to obtain a 1.3 μm or less periodic distance of the phase-separation structure of the reversible thermosensitive recording layer, while measuring the scattering angle of a light transmitted through the reversible thermosensitive recording layer by the light-scattering method.

4 Claims, 8 Drawing Sheets

REVERSIBLE THERMOSENSITIVE RECORDING MATERIAL AND METHOD FOR PRODUCING THE SAME

BACKGROUND OF THE INVENTION

1. Field of the Invention

The present invention relates to a reversible thermosensitive recording material capable of recording and erasing images repeatedly by utilizing its property that the transparency can be changed reversibly from a transparent state to an opaque state, and vice versa, depending upon the temperature thereof, and a method for producing the above-mentioned reversible thermosensitive recording material.

2. Discussion of Background

Recently attention has been paid to a reversible thermosensitive recording material capable of temporarily recording images thereon and erasing the same therefrom when such images become unnecessary. For example, as disclosed in Japanese Laid-Open Patent Applications 54-119377, 55-154198, 63-39376 and 63-107584, there are conventionally known reversible thermosensitive recording materials in which an organic low-molecular-weight material such as a higher fatty acid is dispersed in a matrix resin such as a vinyl chloride—vinyl acetate resin with a glass transition temperature (Tg) of as low as 50° C. or more to less than 80° C.

In the case where only heat energy is applied to a reversible thermosensitive recording material by using a heat-application roller or a heat-pen, with the application of slight pressure thereto, in order to perform recording and erasing operations, the durability of the recording material is not degraded even though the image formation and erasure are repeated. However, when both heat and pressure are repeatedly applied to the recording material at the same time for image recording and erasing, for instance, by using a thermal head, the matrix resin enclosing domains of the organic low-molecular-weight material is deformed in the reversible thermosensitive recording layer, so that the domains of the low-molecular-weight material which are discretely dispersed in the matrix resin at the initial stage are apt to coalesce. The size of each domain of the low-molecular-weight material is thus increased, with the result that the light scattering effect of the recording layer is decreased, and the degree of whiteness of the milky white opaque area in the recording layer is undesirably degraded. Finally the image quality and the contrast are lowered.

SUMMARY OF THE INVENTION

Accordingly, a first object of the present invention is to provide a reversible thermosensitive recording material with improved durability during the repeated recording and erasing operations, capable of showing sufficiently high transparency so as to yield clear images with high contrast.

A second object of the present invention is to provide a method for producing the above-mentioned reversible thermosensitive recording material in a stable condition.

The above-mentioned first object of the present invention can be achieved by a reversible thermosensitive recording material which comprises a support and a reversible thermosensitive recording layer formed on the support, comprising a matrix resin and an organic low-molecular-weight material, the organic low-molecular-weight material being dispersed in the form of discrete domains in the matrix resin, thereby constituting a phase-separation structure, with the periodic distance of the phase-separation structure of the reversible thermosensitive recording layer being 1.3 μm or less.

The second object of the present invention can be achieved by a method of producing a reversible thermosensitive recording material comprising the steps of applying a coating liquid comprising an organic low-molecular-weight material and a matrix resin which are dissolved in a solvent to a support to form a reversible thermosensitive recording layer on the support; and drying the applied coating liquid under such conditions controlled so as to obtain a 1.3 μm or less periodic distance of the phase-separation structure of the reversible thermosensitive recording layer, while measuring the scattering angle of a light transmitted through the reversible thermosensitive recording layer by the light-scattering method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2, part (*b*) is a graph in explanation of the periodic distance of structure in the two materials constituting the phase-separation structure shown in FIG. 2(*a*);

FIG. 3(*b*) is a graph which shows the relationship between the intensity of the scattered light and the scattering angle;

DESCRIPTION OF THE PREFERRED EMBODIMENTS

A reversible thermosensitive recording layer of the recording material according to the present invention is switched from a milky white opaque state to a transparent state, or vice versa, depending on the temperature thereof. In the transparent state and the milky white opaque state of the reversible thermosensitive recording layer, the size of the crystals of the organic low-molecular-weight material, which is dispersed in the form of discrete domains in a matrix resin, is considered to be different. In the transparent state, the organic low-molecular-weight material consists of relatively large crystals, possibly most of them being single crystals, so that the light which enters the crystals from one side passes therethrough to the opposite side, without being scattered, thus the reversible thermosensitive recording material appears transparent. In contrast to this, when the thermosensitive recording material is in the milky white opaque state, the organic low-molecular-weight material is composed of polycrystals consisting of numerous small crystals, with the crystallographic axes pointed to various directions, so that the light which enters the recording layer is scattered a number of times on the interface of the crystals of the organic low-molecular-weight material. As a result, the thermosensitive recording layer becomes opaque in a milky white color.

The transition of the state of the reversible thermosensitive recording layer depending on the temperature thereof will now be explained by referring to FIG. 1.

Figure 1:
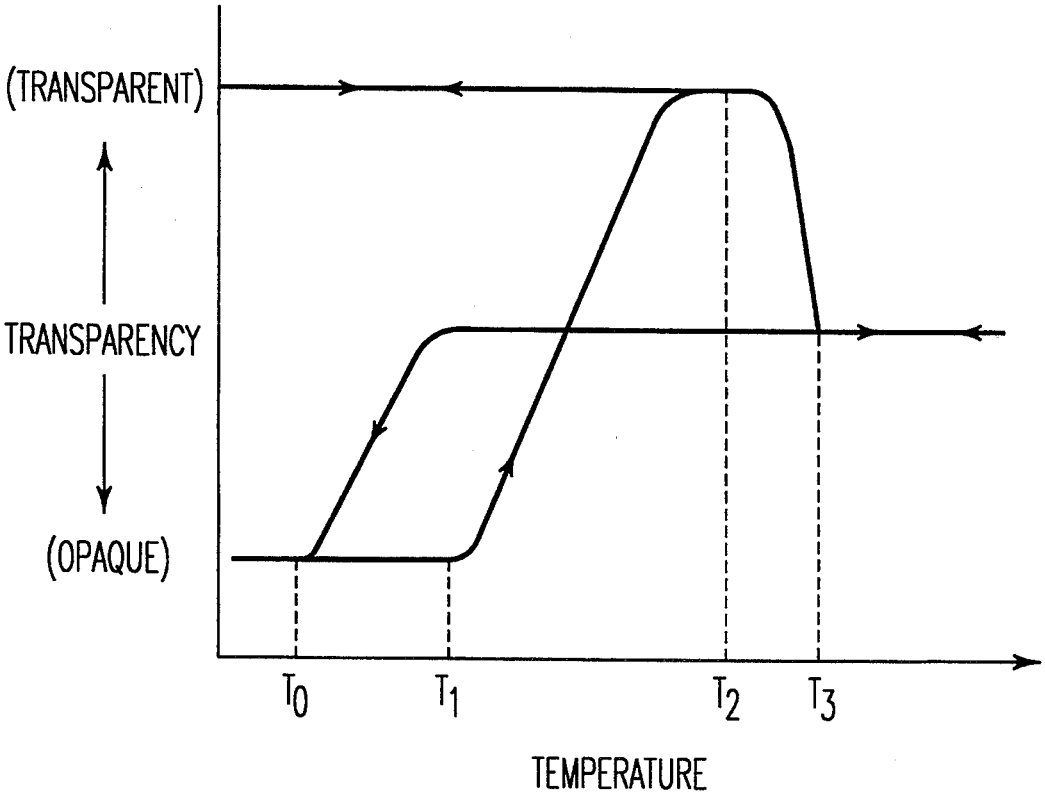
FIG. 1 is a graph in explanation of the principle of the formation and erasion of images in a reversible thermosensitive recording material according to the present invention.

In FIG. 1, it is supposed that the reversible thermosensitive recording layer comprising a matrix resin and an organic low-molecular-weight material dispersed in the matrix resin is initially in a milky white opaque state at room temperature $T_0$ or below. When the thermosensitive recording material is heated to temperature $T_2$, the thermosensitive recording layer becomes transparent. Thus, the recording material reaches a maximum transparent state at temperature $T_2$. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording layer in the maximum transparent state is further heated to temperature $T_3$ or more, it reaches a medium state which is between the maximum transparent state and the maximum milky white opaque state. When the recording material in the medium state at temperature $T_3$ or more is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when cooled to room temperature $T_0$ or below. If the recording material in the milky white opaque state is heated to any temperature between temperature $T_1$ and temperature $T_2$, and then cooled to room temperature $T_0$ or below, the recording material reaches an intermediate state between the transparent state and the milky white opaque state.

When the recording material in the transparent state at room temperature $T_0$ is again heated to temperature $T_3$ or above, and then cooled to room temperature $T_0$, the recording material returns to the maximum milky opaque state. Thus, the reversible thermosensitive recording material according to the present invention can be in a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording material according to the present invention. Further, such image formation and erasure can be repeated over a long period of time.

As previously explained, the image recording and erasing process in the reversible thermosensitive recording material is based on the property that the organic low-molecular-weight material dispersed in the reversible thermosensitive recording layer changes its crystalline state. More specifically, the light scattering is caused when the organic low-molecular-weight material is in the polycrystalline state composed of numerous small crystals; and the light transmission is caused when the organic low-molecular-weight material is in the single-crystalline state composed of relatively large crystals. Accordingly, the crystal growth of the organic low-molecular-weight material and the effects thereof are determined by the phase-separation structure composed of the organic low-molecular-weight material and the matrix resin in the reversible thermosensitive recording layer.

The periodic distance of structure becomes important in the analysis of the phase-separation structure of the reversible thermosensitive recording layer. The size of a phase-separation structure can be expressed by the periodic distance of structure.

Figure 2A:
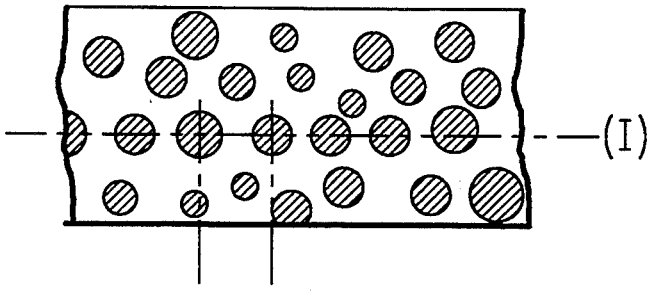
FIG. 2, part (*a*) is a schematic view which shows two materials constituting a phase-separation structure.
Figure 2B:
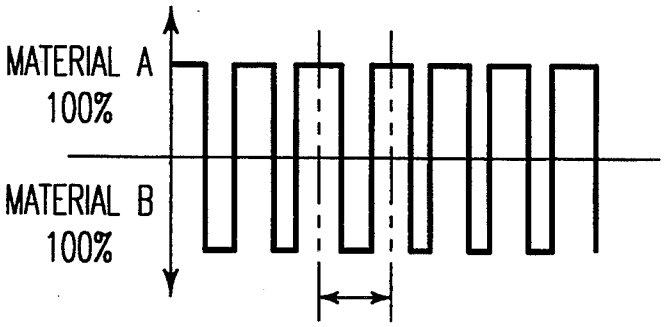

For instance, FIG. 2(*a*) schematically shows a phase-separation structure composed of a material A (shaded portion) and a material B (white area), with the material A being dispersed in the form of discrete spherical domains in the material B. When a section of the phase-separation structure cut by a dashed line (I) as shown in FIG. 2(*a*) is observed, it is assumed that the composition of the material A and the material B periodically changes as shown in FIG. 2(*b*). The distance enclosed by the arrows is called the periodic distance of structure.

All the phase-separation structures do not always have the aforementioned periodic distance of structure. The periodic distance of structure can be found and becomes meaningful when the following conditions are collectively satisfied:

(1) The phase-separation structure has the regularity and the characteristics to a certain extent.

(2) The volume ratio of the material A to the material B is not excessively large or small in the phase-separation structure.

(3) The material A and the material B are conspicuously separated from each other in the phase-separation structure.

In the reversible thermosensitive recording material of the present invention, the organic low-molecular-weight material and the matrix resin respectively serve as the material A and the material B. It is considered that there is a periodic distance in the phase-separation structure of the reversible thermosensitive recording layer composed of the organic low-molecular-weight material and the matrix resin in the case where the above-mentioned three conditions are collectively satisfied to a certain extent.

Figure 3A:
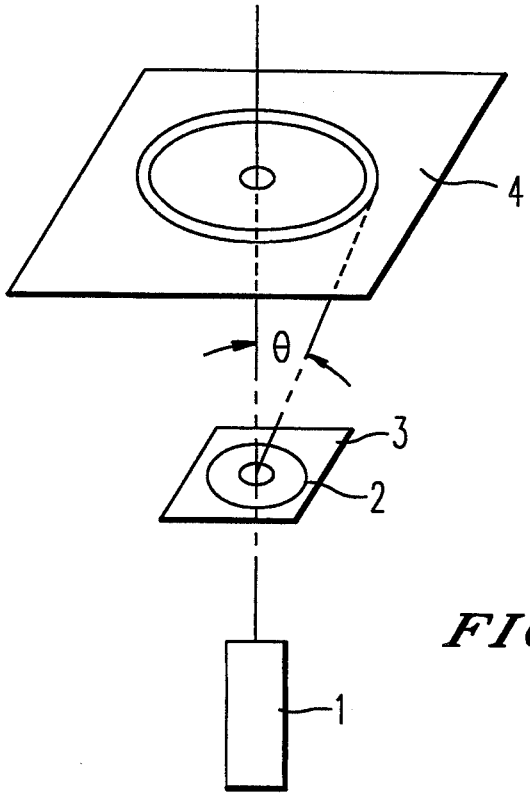
FIG. 3(*a*) is a schematic view which shows the light scattering measuring method.
Figure 3B:
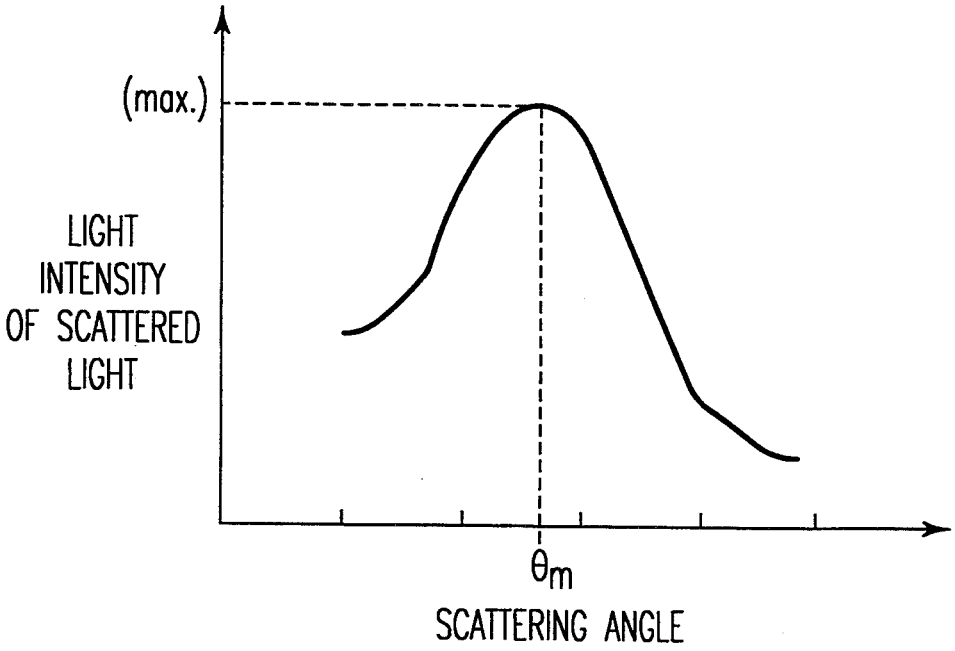

The periodic distance of the phase-separation structure can be efficiently obtained by the light-scattering method generally used in the structure analysis of organic polymeric compounds. FIG. 3(*a*) is a schematic view in explanation of the light-scattering method, by which the light is applied from a light source 1 to a sample 2 placed on a stand 3, and the scattering angle ($\theta$) of the light transmitted through the sample 2 is obtained by projecting the scattered light on a projecting sheet 4. The periodic distance of structure ($\Lambda$) is calculated from the scattering angle ($\sigma$) of the transmitted light in accordance with the following formula (1):

$$\Lambda = \frac{\lambda/D}{2\sin(\sigma/2)}\ [\mu m] \qquad (1)$$

wherein $\lambda$ represents the wavelength ($\mu$m) of the light applied to the sample 2; D, the refractive index of the sample 2; and $\sigma$, the scattering angle of the transmitted light.

In general, the laser beam, especially, He—Ne laser beam is preferably employed as the light source in the above light scattering method.

When a sample with the phase-separation structure which meets the previously mentioned conditions (1) through (3) is subjected to the light-scattering measurement, the light intensity distribution of the scattered light forms a ring as shown in FIG. 3(*a*). When the light intensity of the scattered light is plotted as ordinate and the scattering angle as abscissa, a curve is obtained as shown in FIG. 3(*b*), which indicates the peak value (max) of the light intensity at a scattering angle ($\theta$m). By substituting the scattering angle ($\theta$m) obtained at the maximum light intensity for "$\sigma$" in the formula (1), the periodic distance of structure ($\Lambda$) characteristic of the sample 2 with the phase-separation structure can be obtained.

For instance, the periodic distance of the phase-separation structure of a reversible thermosensitive recording layer of the recording material according to the present invention can be obtained by the light-scattering measurement using a commercially available light-scattering measuring apparatus "GP-7" (Trademark), made by Optics Co., Ltd., which employs the He—Ne laser beam with a wavelength ($\lambda$) of 0.6328 $\mu$m as the light source. It is necessary that the reversible thermosensitive recording material to be subjected to the light-scattering measurement have light transmitting characteristics in a certain degree. Therefore, when the reversible thermosensitive recording layer is formed on an opaque support, it is required to remove the opaque support from the recording material for the light-scattering measurement.

Figure 4:
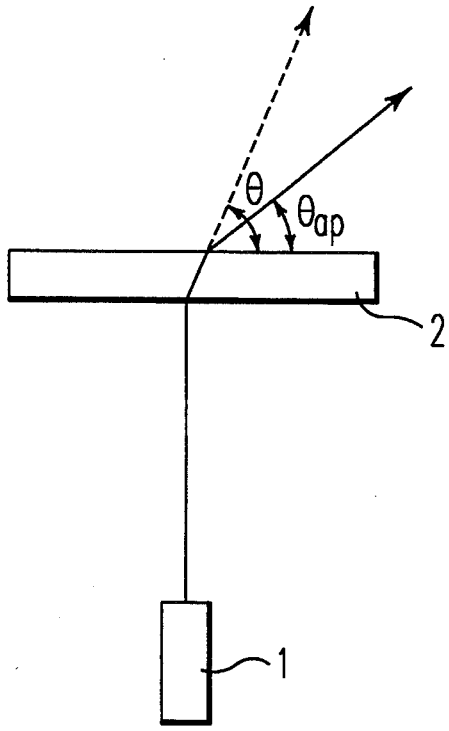
FIG. 4 is a schematic view in explanation of the relationship between the apparent scattering angle and the true scattering angle.

Furthermore, in measuring the scattering angle of the transmitted light, it is necessary to make a correction with respect to the obtained scattering angle, with the difference between the refractive index of the sample and that of air taken into consideration because the reversible thermosensitive recording layer is in the form of a film. As illustrated in FIG. 4, the light applied from a light source 1 to a film-shaped sample 2 is scattered therein, and the scattered light is further refracted by the interface between the film and air. Accordingly, the correction is necessary because the apparent scattering angle ($\theta_{ap}$) is smaller than the true scattering angle ($\theta$).

The reversible thermosensitive recording layer of the recording material according to the present invention changes among the white opaque state, the transparent state, and the medium state of the above two states depending on the temperature of the recording material. Since the light is hardly scattered in the transparent recording layer, the measurement is carried out when the recording layer is in the state of the white opaque state or semitransparent state. Although the light intensity distribution of the scattered light obtained when the measurement is carried out under the conditions that the reversible thermosensitive recording layer is in the white opaque state is slightly different from the one in the semitransparent state, the scattering angle ($\theta_m$) obtained at the peak value of the light intensity is almost the same. Accordingly, the light-scattering measurement may be carried out under the conditions that the reversible thermosensitive recording layer is either in the white opaque state or in the semitransparent state.

When a colored sheet is placed behind the reversible thermosensitive recording layer of the recording material, a colored image can be obtained on a white opaque background or a white opaque image can be obtained on a colored background.

In the case where the images formed on the reversible thermosensitive recording material of the present invention are projected on a screen using an OHP (Over Head Projector), a milky white opaque portion in the recording material appears dark and a transparent portion in the recording material, through which the light passes becomes a bright portion on the screen.

To form the image in the reversible thermosensitive recording material of the present invention and erase it therefrom, two thermal heads, one for the image formation and the other for the image erasure may be used. Alternatively, a single thermal head is available if the conditions of application of the heat energy to the recording material can be changed depending on the recording operation and the erasing operation.

In the case where two thermal heads are used, although a device for the reversible thermosensitive recording material is expensive, the image formation and erasure can easily be performed by once causing the recording material to pass through the two thermal heads in series from which the different heat energy is separately applied to the recording material corresponding to the image formation and image erasure.

On the other hand, in the case where a single thermal head is used for both image formation and erasure, the cost of the device can be decreased, but the operation becomes complicated. More specifically, it is necessary to delicately change the heat application conditions of the single thermal head corresponding to a portion where an image is to be recorded or erased while the recording material is caused to pass through the single thermal head at one operation. Alternatively, the images are first erased by applying the thermal energy for image erasure to the recording material while the recording material is caused to pass through the single thermal head. Then, when the recording material is caused to reciprocatively pass through the single thermal head, the images are recorded by the application of the thermal energy for image formation to the recording material.

The reversible thermosensitive recording material according to the present invention can be obtained by forming a reversible thermosensitive recording layer on a support. To form the reversible thermosensitive recording layer on the support, a solution in which a matrix resin and an organic low-molecular-weight material are dissolved is coated on the support such as a plastic film, glass plate or metallic plate, and then dried.

In the present invention, the reversible thermosensitive recording layer with the phase-separation structure has a periodic distance of phase-separation structure of 1.3 μm or less, and preferably 1.0 μm or less. To prepare the reversible thermosensitive recording layer with such a phase-separation structure, the solvent concentration in a coating liquid for the reversible thermosensitive recording layer may be adjusted or/and the drying conditions of the applied recording layer may appropriately be controlled. Preferably, both the control of the solvent concentration in the coating liquid, and the control of the drying conditions may be conducted at the same time.

More specifically, the periodic distance of the phase-separation structure of the reversible thermosensitive recording layer can be controlled by the drying conditions after the coating liquid for the recording layer is coated on the support. The larger the drying power, namely, the higher the drying rate, the smaller the periodic distance of structure of the obtained reversible thermosensitive recording layer. However, mere increase of the drying power causes the solvent in the coating liquid to rapidly boil, thereby generating bubbles. As a result, the surface of the obtained recording layer is not uniform because pinholes and cissing are generated.

It is found that the control of the solvent concentration in the coating liquid for the recording layer or/and the selection of the drying conditions thereof are effective for obtaining the reversible thermosensitive recording material of the present invention. It is preferable that the amount of the mixture of the matrix resin and the organic low-molecular-weight material be 25 wt. % or more of the total weight of the coating liquid for the thermosensitive recording layer. In such a coating liquid, the interaction between the solvent and the matrix resin or the organic low-molecular-weight material becomes so strong as to prevent the coating liquid from rapidly boiling. In addition to this, the viscosity of the coating liquid is appropriately increased, so that the cissing in the obtained recording layer can be avoided.

Alternatively, it is desirable that the drying conditions of the applied thermosensitive recording layer be so controlled as to cause 90 wt. % or more of the solvent in the coating liquid for the recording layer to evaporate within 40 seconds after the drying operation is started. Thereafter, as a matter of course, it is necessary to continue the drying operation until the residual solvent component is eliminated from the recording layer. The drying conditions to evaporate the residual solvent component has very little effect on the periodic distance of structure of the obtained recording layer so long as extremely high thermal energy is not applied to the recording layer.

Furthersnote, in preparing the reversible thermosensitive recording layer with a periodic distance of phase-separation structure of as small as 1.0 μm or less, it is effective to repeatedly apply the recording layer coating liquid little by little for the formation of a laminated-type reversible thermosensitive recording layer. This is because a thin layer dries more quickly than a thick layer under the same drying conditions. The uniform recording layer can easily be obtained by the above-mentioned film-forming method as compared with the method of rapidly heating the applied coating liquid because the solvent component in the coating liquid can be prevented from boiling.

As previously mentioned, the periodic distance of the phase-separation structure of the obtained reversible thermosensitive recording layer varies depending upon the drying conditions of the applied recording layer. Therefore, in the method of producing the reversible thermosensitive recording material according to the present invention, the drying conditions are so controlled as to obtain the periodic distance of structure of 1.3 μm or less while the light-scattering measurement of the reversible thermosensitive recording layer is conducted in the process of forming the recording layer.

Figure 5:
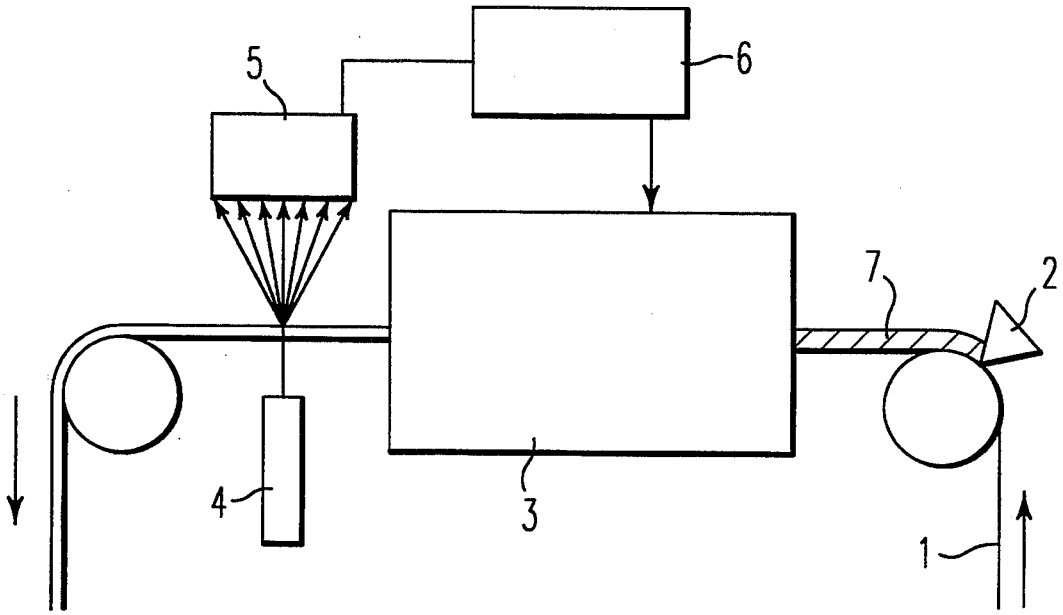
FIG. 5 is a schematic view which shows one embodiment of the system for fabricating a reversible thermosensitive recording material of the present invention.

FIG. 5 schematically shows one embodiment of the system for fabricating a reversible thermosensitive recording material of the present invention.

As shown in FIG. 5, using a coating head 2, a coating liquid for the reversible thermosensitive recording layer is coated on a support 1 for use in the reversible thermosensitive recording material of the present invention, so that a reversible thermosensitive recording layer 7 is formed on the support 1. The recording layer 7 thus applied is sent into a dryer 3 to form the phase-separation structure with a periodic distance of structure of 1.3 μm or less. In FIG. 5, the periodic distance of the phase-separation structure of the reversible thermosensitive recording layer is measured by the light-scattering method immediately after the recording material comes out of the dryer 3. For the measurement, the light is applied from a light source 4 to the recording material, the scattering angle of the light transmitted through the recording material is detected by a scattered light detector 5, and then the data of the scattering angle is sent to a data processor 6. According to the periodic distance of the phase-separation structure thus obtained, the drying conditions of the dryer 3 are controlled.

To speedily measure the scattering angle, it is desirable to use a photodiode array or CCD image sensor as the scattered light detector 5 in the fabricating system shown in FIG. 5. In addition to the above, it is preferable that the light-scattering measuring apparatus composed of the light source 4 and the scattered light detector 5 be scanned in the width direction of the recording material in order to entirely measure the scattering angle of the reversible thermosensitive recording layer.

It is recommended that the light-scattering measurement be carried out under the conditions that the recording layer is in the medium state between the milky white opaque state and the transparent state, with the controlled thermal energy being applied to the reversible thermosensitive recording material. This is because the most accurate peak value of the light scattering angle can be obtained when the reversible thermosensitive recording material is in the medium state. Accordingly, the position of the light-scattering measuring apparatus composed of the light source 4 and the scattered light detector 5 may be adjacent to the outlet of the dryer 3, or in the dryer 3. Alternatively, the light-scattering measuring apparatus may be situated at any position where it is possible to control the temperature of the reversible thermosensitive recording material.

A heated-roll dryer by which the rear side of the support, opposite to the recording layer with respect to the support, is brought into contact with a heated roll, a hot-air dryer and an infrared heater can be employed to dry the applied thermosensitive recording layer. In particular, the heated-roll dryer is preferred in the present invention because the heat transfer efficiency is excellent.

Furthermore, at least two kinds of organic solvents with different vapor pressure may be used in dissolving the matrix resin and the organic low-molecular-weight material therein to prepare the coating liquid for the thermosensitive recording layer. Such organic solvents can be selected depending upon the kinds of matrix resin and low-molecular-weight material, and for example, tetrahydrofuran, methyl ethyl ketone, methyl isobutyl ketone, chloroform, carbon tetrachloride, ethanol, toluene and benzene can be employed.

In the thus formed reversible thermosensitive recording layer, the organic low-molecular-weight material is dispersed in the form of discrete domains in the matrix resin. It is preferable to employ such matrix resins that can form a reversible thermosensitive recording layer in the form of a film, and impart high transparency and mechanical stability to the recording layer. Specific examples of the matrix resin include polyvinyl chloride, vinyl chloride copolymers such as vinyl chloride—vinyl acetate copolymer, vinyl chloride—vinyl acetate—vinyl alcohol copolymer, vinyl chloride—vinyl acetate—maleic acid copolymer and vinyl chloride—acrylate copolymer; polyvinylidene chloride, vinylidene chloride copolymers such as vinylidene chloride—vinyl chloride copolymer and vinylidene chloride—acrylonitrile copolymer; polyester; polyamide; polyacrylate, polymethacrylate and acrylate—methacrylate copolymer; and silicone resin. These resins may be used alone or in combination.

The organic low-molecular-weight material for use in the reversible thermosensitive recording layer may appropriately be selected from the materials which are changeable from the polycrystalline state to the single crystalline state in accordance with each of the desired temperatures ranging from $T_0$ to $T_3$ as shown in FIG. 1. It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids, and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials may be used alone or in combination.

It is preferable that the number of carbon atoms of the above-mentioned organic low-molecular-weight material be in the range of 10 to 60, more preferably in the range of 10 to 38, further preferably in the range of 10 to 30. Part of the alcohol groups in the esters may be saturated or unsaturated, and further may be substituted by a halogen. In any case, it is preferable that the organic low-molecular-weight material have at least one atom selected from the group consisting of oxygen, nitrogen, sulfur and a halogen in its molecule. More specifically, it is preferable that the organic low-molecular-weight materials comprise, for instance, —OH, —COOH, —CONH, —COOR (wherein R is $NH_4$ or an alkyl group having 1 to 20 carbon atoms), —NH, —$NH_2$, —S—, —S—S—, —O— or a halogen atom.

Specific examples of the above-mentioned organic low-molecular-weight materials include higher fatty acids such as lauric acid, dodecanoic acid, myristic acid, pentadecanoic acid, palmitic acid, heneicosanoic acid, tricosanoic acid, lignoceric acid, pentacosanoic acid, cerotic acid, montanic acid, melissic acid, stearic acid, behenic acid, nonadecanoic acid, arachic acid, and oleic acid; esters of higher fatty acids such as methyl stearate, tetradecyl stearate, octadecyl stearate, octadecyl laurate, tetradecyl palmitate and dodecyl behenate; and the following ethers or thioethers:

$C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$,

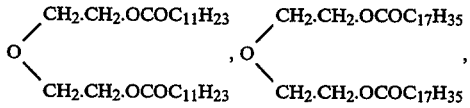

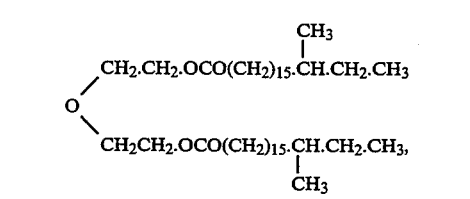

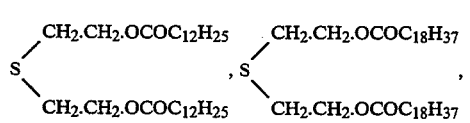

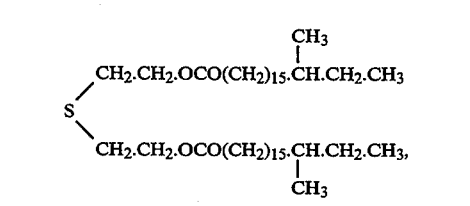

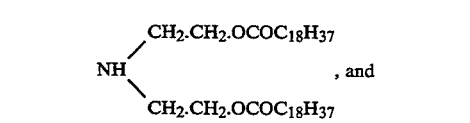

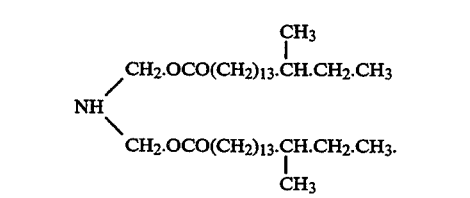

Of these, higher fatty acids having 16 or more carbon atoms, more preferably having 16 to 24 carbon atoms, such as palmitic acid, heneicosanoic acid, tricosanoic acid, lignoceric acid, pentadecanoic acid, nonadecanoic acid, arachic acid, stearic acid and behenic acid are preferred in the present invention.

To increase the temperature region where the reversible thermosensitive recording material is in the transparent state, the above-mentioned organic low-molecular-weight materials may appropriately be used in combination. Alternatively, the above-mentioned organic low-molecular-weight material may be used in combination with other materials having a different melting point, as disclosed in Japanese Laid-Open Patent Applications 63-39378 and 63-130380, and Japanese Patent Applications 1-140109 and 2-1363.

It is preferable that the ratio by weight of the amount of the organic low-molecular-weight material to the amount of the matrix resin be in the range of about (2:1) to (1:16), more preferably in the range of (1:2) to (1:8). When the organic low-molecular-weight material is contained in the matrix resin within the above range, the matrix resin can form a film in which the organic low-molecular-weight material is uniformly dispersed, and the obtained recording layer can readily reach the maximum white opaque state.

It is preferable that the thickness of the reversible thermosensitive recording layer be in the range of 1 to 30 μm, more preferably in the range of 2 to 20 μm. When the thickness of the recording layer is within the aforementioned range, the heat distribution becomes even in the recording layer, which permits the recording layer to assume a uniformly transparent state. In addition, the whiteness degree of a milky opaque portion in the recording layer is not degraded, with the result that the image contrast is not lowered. To increase the whiteness degree in the milky white opaque state of the recording layer, the amount of the organic low-molecular-weight material in the reversible thermosensitive recording layer may be appropriately increased.

In the reversible thermosensitive recording layer for use in the present invention, additives such as a surface-active agent and a high-boiling point solvent may be contained to facilitate the formation of a transparent image.

Specific examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethylbutyrate, methyl acetylricinoleate, butyl acetylricinoleate, butylphthalyl butyl glycolate and tributyl acetylcitrate.

Specific examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil of higher fatty acid, and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; copolymer of long-chain alkyl methacrylate and amine-containing monomer; styrene—maleicanhydride copolymer; and olefin—maleic anhydride copolymer.

As mentioned previously, a plastic film, a glass plate, or a metallic plate can be employed as a support of the reversible thermosensitive recording material of the present invention.

In order to improve the image contrast in the recording material, a light reflection layer may be formed on the back side of the recording layer. In this case, high image contrast can be obtained even if the recording layer is thin. The light reflection layer can be formed by deposition of Al, Ni, Sn, Au and Ag on the support, as disclosed in Japanese Laid-Open Patent Application 64-14079.

To increase the adhesion between the support and the reversible thermosensitive recording layer, an adhesive layer may be interposed between the support and the recording layer, especially when a metal such as Al is deposited on the support, as disclosed in Japanese Laid-Open Patent Application 3-7377.

In addition to the above, a low-refractive-index layer may be formed between the reversible thermosensitive recording layer and the colored layer or the light reflection layer in order to increase the image contrast.

The surface of the reversible thermosensitive recording material is readily deformed when heat and pressure are applied thereto to form and erase the images therein by use of heat application means such as a thermal head. In the present invention, therefore, a protective layer may be further formed on the reversible thermosensitive recording layer to prevent the transparency of a transparent portion of the thermosensitive recording layer from decreasing. It is preferable that the protective layer have a thickness in the range of 0.1 to 10 μm. Examples of the material for the protective layer include silicone rubber or silicone resin (described in Japanese Laid-Open Patent Application 63-221087), polysiloxane graft polymer (described in Japanese Laid-Open Patent Application 63-317385), and ultraviolet-curing resin or electron-radiation-curing resin (described in Japanese Laid-Open Patent Application 2-566).

In order to prevent the dirt and dust from attaching to a thermal head, the surface of the protective layer may be made rough by containing an inorganic or organic filler in the protective layer as disclosed in Japanese Laid-Open Patent Application 4-85077.

In any case, any solvent that cannot easily dissolve the matrix resin and the organic low-molecular-weight material for use in the thermosensitive recording layer is employed for the preparation of a coating liquid for the protective layer.

Preferable examples of the solvent for use in the coating liquid for the protective layer include n-hexane, methyl alcohol, ethyl alcohol and isopropyl alcohol. In particular, alcohol-based solvents are preferred from the viewpoint of cost.

Further, an intermediate layer may be interposed between the protective layer and the thermosensitive recording layer to protect the thermosensitive recording layer from the solvent or a monomer component for use in the coating liquid for the protective layer, as disclosed in Japanese Laid-Open Patent Application 1-13378.

As a material for use in the coating liquid for the intermediate layer, the same resins as used for the matrix resin in the thermosensitive recording layer, and other thermosetting resins and thermoplastic resins such as polyethylene, polypropylene, polystyrene, polyvinyl alcohol, polyvinyl butyral, polyurethane, saturated polyester, unsaturated polyester, epoxy resin, phenolic resin, polycarbonate, and polyamide can be used.

It is preferable that the intermediate layer have a thickness of about 0.1 to 2 μm. When the thickness of the intermediate layer is within the above range, the recording layer can be protected and the thermosensitivity of the recording layer can be maintained.

The reversible thermosensitive recording material of the present invention can be employed as a magnetic card by the provision of a magnetic recording layer therein, as disclosed in Japanese Laid-Open Utility Model Application 2-3876, and Japanese Laid-Open Patent Application 3-130188.

Since the periodic distance of the phase-separation structure of the reversible thermosensitive recording layer in which the organic low-molecular-weight material is dispersed in the form of discrete domains in the matrix resin is 1.3 μm or less in the present invention, the transparency of the recording layer in the maximum transparent state is very high, with the result that sufficient image contrast can be obtained. In addition, the reversible thermosensitive recording material of the present invention shows excellent durability during the repeated recording and erasing operations by use of a thermal head.

The reasons for the above-mentioned improvements have not yet clarified, but it is supposed that the crystalline state of the organic low-molecular-weight material, and the interaction between the low-molecular-weight material and the matrix resin which has an effect on the light scattering properties of the low-molecular-weight material vary depending on the periodic distance of structure of the reversible thermosensitive recording layer with the phase-separation structure.

Namely, it is considered that the following two factors determine the light transmission properties and the light scattering properties of the reversible thermosensitive recording layer:

(1) a factor whether each domain of the low-molecular-weight material is composed of single crystals which easily transmit the light, or polycrystals in which the light is readily scattered; and (2) a factor whether the overall structure of the recording layer in which numerous domains of the organic low-molecular-weight material are dispersed in the matrix resin is so built as to easily transmit the light or scatter the light.

The factor (1) is an effect of the interaction between the low-molecular-weight material and the matrix resin corresponding to the change in the crystalline state of each domain of the low-molecular-weight material. The factor (2) results from the optical interaction between the organic low-molecular-weight material and the matrix resin with respect to the light scattering properties and the light transmission properties. It is supposed that there is a causal relationship between each interaction in the factor (1) or (2) and the phase-separation structure of the reversible thermosensitive recording layer, and the effects of those interactions change depending on the periodic distance of structure of the reversible thermosensitive recording layer with the phase-separation structure. When the periodic distance of phase-separation structure of the recording layer is 1.3 μm or less, the transparency of a transparent portion in the recording layer is remarkably high, with the result that images can be formed with high contrast.

The reason for the high durability of the reversible thermosensitive recording material according to the present invention will now be considered. In general, the whiteness degree of a milky opaque portion in the thermosensitive recording layer gradually decreases as the recording and erasing operations are repeated by use of the thermal head. This is because the phase-separation structure of the reversible thermosensitive recording layer is destroyed by the repeated application of heat and pressure to the recording material. Even though the domains of the organic low-molecular-weight material are distinctly formed in the matrix resin with a relatively small periodic distance of structure at the initial stage, the boundaries of the domains become obscure and the periodic distance of the phase-separation structure is increased because the domains are destroyed and coalesce in the course of the repeated recording and erasing operations. As a result, the degree of milky whiteness of the recording layer is decreased. In the reversible thermosensitive recording material according to the present invention, however, since the periodic distance of the phase-separation structure of the reversible thermosensitive recording layer is sufficiently small at the initial stage, the decrease in the whiteness degree of a milky opaque portion in the recording layer due to the destruction and coalescence of the domains of the low-molecular-weight material can be prevented to a large extent as compared with the recording layer which shows a large periodic distance of the phase-separation structure at the initial stage.

The improvement in the durability is still remarkable in the case where the periodic distance of the phase-separation structure of the reversible thermosensitive recording layer is as small as 1.0 μm or less.

Other features of this invention will become apparent in the course of the following description of exemplary embodiments which are given for illustration of the invention and are not intended to be limiting thereof.

EXAMPLE 1

Formation of Reversible Thermosensitive Recording Layer

The following components were mixed to prepare a coating liquid for a reversible thermosensitive recording layer:

| | Parts by Weight |
|---|---|
| Behenic acid | 6 |
| Eicosanedioic acid | 4 |
| Vinyl chloride-vinyl acetate copolymer (Trademark: "Denka Vinyl #1000GK", made by Denki Kagaku Kogyo K.K.) | 40 |
| Diisodecyl phthalate | 3 |
| Tetrahydrofuran | 60 |
| Toluene | 20 |

The thus obtained coating liquid for a recording layer was coated on a transparent polyester film with a thickness of about 50 μm serving as a support by a wire bar. The back side of the support, opposite to the surface to which the coating liquid was applied, was brought into contact with a heat-application roller having a stainless steel planished surface of 90° C. for 40 seconds, and the applied coating liquid for the recording layer was further dried in a hot-air dryer of 100° C. for 60 seconds, whereby a reversible thermosensitive recording layer with a thickness of 10 μm was formed on the support.

Formation of Protective Layer

The following components were mixed to prepare a coating liquid for a protective layer:

| | Parts by Weight |
|---|---|
| 75% butyl acetate solution of urethane acrylate-based ultraviolet-curing resin (Trademark: "Unidic C7-157", made by Dainippon Ink & Chemicals, Incorporated.) | 10 |
| Isopropyl alcohol | 10 |

The thus obtained coating liquid was coated on the reversible thermosensitive recording layer by a wire bar, dried in a hot-air dryer of 100° C. for 60 seconds, and cured by the irradiation of an ultraviolet lamp of 80 W/cm, whereby a protective layer with a thickness of about 2 μm was formed on the reversible thermosensitive recording layer.

Thus, a reversible thermosensitive recording material No. 1 according to the present invention was obtained.

EXAMPLE 2

Formation of Reversible Thermosensitive Recerding Layer

The following components were mixed to prepare a coating liquid for a reversible thermosensitive recording layer:

| | Parts by Weight |
|---|---|
| Behenic acid | 6 |
| Eicosanedioic acid | 4 |
| Vinyl chloride-vinyl acetate copolymer (Trademark: "Denka Vinyl #1000GK", made by Denki Kagaku Kogyo K.K.) | 40 |
| Diisodecyl phthalate | 3 |
| Tetrahydrofuran | 110 |
| Toluene | 37 |

The thus obtained coating liquid for a recording layer was coated on a transparent polyester film with a thickness of about 50 μm serving as a support by a wire bar. The back side of the support, opposite to the surface to which the coating liquid was applied, was brought into contact with a heat-application roller having a stainless steel planished surface of 80° C. for 40 seconds, and the applied coating liquid for the recording layer was further dried in a hot-air dryer of 100° C. for 60 seconds, whereby a reversible thermosensitive recording layer with a thickness of 10 μm was formed on the support.

Then, a protective layer was formed on the above prepared reversible thermosensitive recording layer in the same manner as in Example 1.

Thus, a reversible thermosensitive recording material No. 2 according to the present invention was obtained.

EXAMPLE 3

The procedure for preparation of the reversible thermosensitive recording material No. 2 in Example 2 was repeated except that the surface temperature of the heat-application roller employed in Example 2 was changed from 80° C. to 90° C. and the heat-application roller was covered with a cloth with a thickness of about 100 μm in the course of drying the coating liquid for the reversible thermosensitive recording layer, whereby a reversible thermosensitive recording material No. 3 according to the present invention was obtained.

EXAMPLE 4

The procedure for preparation of the reversible thermosensitive recording material No. 2 in Example 2 was repeated except that the heat-application roller with a surface temperature of 80° C. was covered with a cloth with a thickness of about 100 μm in the course of drying the coating liquid for the reversible thermosensitive recording layer, whereby a reversible thermosensitive recording material No. 4 according to the present invention was obtained.

EXAMPLE 5

The procedure for preparation of the reversible thermosensitive recording material No. 2 in Example 2 was repeated except that the formulation of the coating liquid for the reversible thermosensitive recording layer in Example 2 was replaced by the following formulation:

| | Parts by Weight |
|---|---|
| Behenic acid | 6 |
| Eicosanedioic acid | 4 |
| Vinyl chloride-vinyl acetate copolymer (Trademark: "Denka Vinyl #1000GK", made by Denki Kagaku Kogyo K.K.) | 30 |
| Diisodecyl phthalate | 2 |
| Tetrahydrofuran | 89 |
| Toluene | 29 |

Thus, a reversible thermosensitive recording material No. 5 according to the present invention was obtained.

EXAMPLE 6

The procedure for preparation of the reversible thermosensitive recording material No. 3 in Example 3 was repeated except that the formulation of the coating liquid for the reversible thermosensitive recording layer employed in Example 3 was replaced by the one in Example 5, whereby a reversible thermosensitive recording material No. 6 according to the present invention was obtained.

EXAMPLE 7

The procedure for preparation of the reversible thermosensitive recording material No. 4 in Example 4 was repeated except that the formulation of the coating liquid for the reversible thermosensitive recording layer employed in Example 4 was replaced by the one in Example 5, whereby a reversible thermosensitive recording material No. 7 according to the present invention was obtained.

EXAMPLE 8

Formation of Reversible Thermosensitive Recording Layer

The following components were mixed to prepare a coating liquid for a reversible thermosensitive recording layer:

| | Parts by Weight |
|---|---|
| Behenic acid | 6 |
| Eicosanedioic acid | 4 |
| Vinyl chloride-vinyl acetate copolymer (Trademark: "Denka Vinyl #1000GK", made by Denki Kagaku Kogyo K.K.) | 40 |
| Diisodecyl phthalate | 3 |
| Tetrahydrofuran | 110 |
| Toluene | 37 |

The thus obtained coating liquid for a recording layer was coated on a transparent polyester film with a thickness of about 50 μm serving as a support by a wire bar. The applied coating liquid for the recording layer was dried in a hot-air dryer of 130° C. for 30 seconds, and then in a hot-air dryer of 100° C. for 60 seconds, whereby a reversible thermosensitive recording layer with a thickness of 15 μm was formed on the support.

Then, a protective layer was formed on the above prepared reversible thermosensitive recording layer in the same manner as in Example 1.

Thus, a reversible thermosensitive recording material No. 8 according to the present invention was obtained.

EXAMPLE 9

Formation of Reversible Thermosensitive Recording Layer

The following components were mixed to prepare a coating liquid for a reversible thermosensitive recording layer:

| | Parts by Weight |
|---|---|
| Behenic acid | 6 |
| Eicosanedioic acid | 4 |
| Vinyl chloride-vinyl acetate copolymer (Trademark: "Denka Vinyl #1000GK", made by Denki Kagaku Kogyo K.K.) | 40 |
| Diisodecyl phthalate | 3 |
| Tetrahydrofuran | 110 |
| Toluene | 37 |

The thus obtained coating liquid for a recording layer was coated on a transparent polyester film with a thickness of about 50 μm serving as a support by a wire bar. The back side of the support, opposite to the surface to which the coating liquid was applied, was brought into contact with a heat-application roller having a stainless steel planished surface of 80° C. for 40 seconds, and the applied coating liquid for the recording layer was further dried in a hot-air dryer of 100° C. for 60 seconds, whereby a first reversible thermosensitive recording layer with a thickness of 5 μm was formed on the support.

Successively, the same coating liquid as used in the formation of the first reversible thermosensitive recording layer was applied to the first recording layer and dried in the same manner as previously mentioned, so that a second reversible thermosensitive recording layer with a thickness of 5 μm was formed on the first recording layer.

Then, a protective layer was formed on the above prepared reversible thermosensitive recording layer in the same manner as in Example 1.

Thus, a reversible thermosensitive recording material No. 9 according to the present invention was obtained.

Comparative Example 1

Formation of Reversible Thermosensitive Recording Layer

The following components were mixed to prepare a coating liquid for a reversible thermosensitive recording layer:

| | Parts by Weight |
|---|---|
| Behenic acid | 6 |
| Eicosanedioic acid | 4 |
| Vinyl chloride-vinyl acetate copolymer (Trademark: "Denka Vinyl #1000GK", made by Denki Kagaku Kogyo K.K.) | 40 |
| Diisodecyl phthalate | 3 |
| Tetrahydrofuran | 148 |
| Toluene | 49 |

The thus obtained coating liquid was coated on a transparent polyester film with a thickness of about 50 μm serving as a support by a wire bar, and dried in a hot-air dryer of 100° C. for 90 seconds, whereby a reversible thermosensitive recording layer with a thickness of 15 μm was formed on the support.

Formation of Protective Layer

The following components were mixed to prepare a coating liquid for a protective layer:

| | Parts by Weight |
|---|---|
| 75% butyl acetate solution of urethane acrylate-based ultraviolet-curng resin (Trademark: "Unidic C7-157", made by Dainippon Ink & Chemicals, Incorporated.) | 10 |
| Isopropyl alcohol | 10 |

The thus obtained coating liquid was coated on the reversible thermosensitive recording layer by a wire bar, dried in a hot-air dryer of 100° C. for 60 seconds, and cured by the irradiation of an ultraviolet lamp of 80 W/cm, whereby a protective layer with a thickness of about 2 μm was formed on the reversible thermosensitive recording layer.

Thus, a comparative reversible thermosensitive recording material No. 1 was obtained.

ComparatiVe Example 2

The procedure for preparation of the comparative reversible thermosensitive recording material No. 1 in Comparative Example 1 was repeated except that the thickness of the reversible thermosensitive recording layer was changed from 15 μm to 10 μm, whereby a comparative reversible thermosensitive recording material No. 2 was obtained.

Comparative Example 3

The procedure for preparation of the reversible thermosensitive recording material No. 2 in Example 2 was repeated except that the formulation of the coating liquid for the reversible thermosensitive recording layer employed in Example 2 was changed to the one in Comparative Example 1.

Thus, a comparative reversible thermosensitive recording material No. 3 was obtained.

Comparative Example 4

The procedure for preparation of the comparative reversible thermosensitive recording material No. 2 in Comparative Example 2 was repeated except that the formulation of the coating liquid for the reversible thermosensitive recording layer employed in Comparative Example 2 was changed to the one in Example 5.

Thus, a comparative reversible thermosensitive recording material No. 4 was obtained.

Comparative Example5

Formation of Reversible Thermosensitive Recording Layer

The following components were mixed to prepare a coating liquid for a reversible thermosensitive recording layer:

| | Parts by Weight |
|---|---|
| Behenic acid | 6 |
| Eicosanedioic acid | 4 |
| Vinyl chloride-vinyl acetate copolymer (Trademark: "Denka Vinyl #1000GK", made by Denki Kagaku Kogyo K.K.) | 40 |
| Diisodecyl phthalate | 3 |
| Tetrahydrofuran | 210 |
| Toluene | 70 |

The thus obtained coating liquid was coated on a transparent polyester film with a thickness of about 50 μm serving as a support by a wire bar, and dried in a hot-air dryer of 90° C. for 90 seconds, whereby a reversible thermosensitive recording layer with a thickness of 10 μm was formed on the support.

Then, a protective layer was formed on the above prepared reversible thermosensitive recording layer in the same manner as in Example 1.

Thus, a comparative reversible thermosensitive recording material No. 5 was obtained.

Each of the above prepared reversible thermosensitive recording materials was subjected to the light-scattering measurement to obtain a scattering angle in such a manner that each recording material was heated to 85° C. to assume the medium state between the milky white opaque state and the transparent state. The periodic distance of the phase-separation structure in the reversible thermosensitive recording layer was obtained from the scattering angle in accordance with the previously mentioned formula (1), with the refractive index (D) of the thermosensitive recording layer being 1.5. The results are shown in Table 1.

Figure 6:
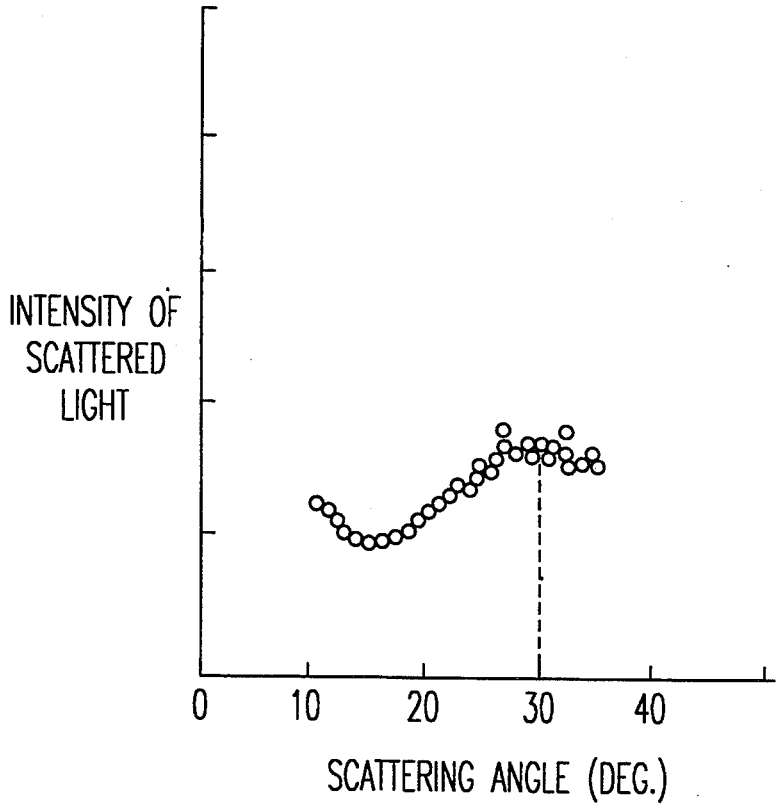
FIG. 6 is a graph which shows the relationship between the intensity of the scattered light and the scattering angle, which is obtained in Example 1.
Figure 7:
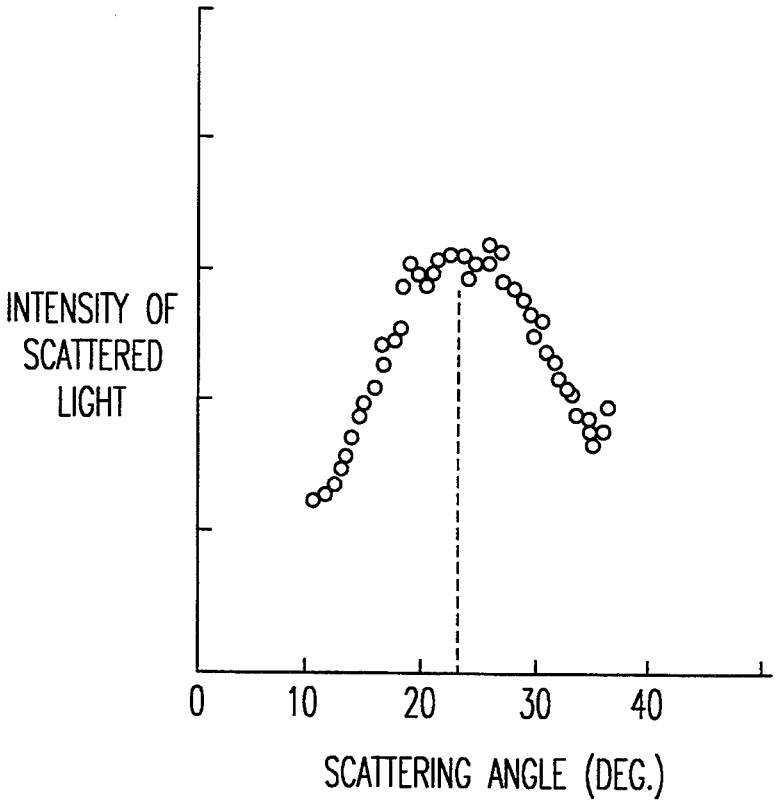
FIG. 7 is a graph which shows the relationship between the intensity of the scattered light and the scattering angle, which is obtained in Example 3.
Figure 8:
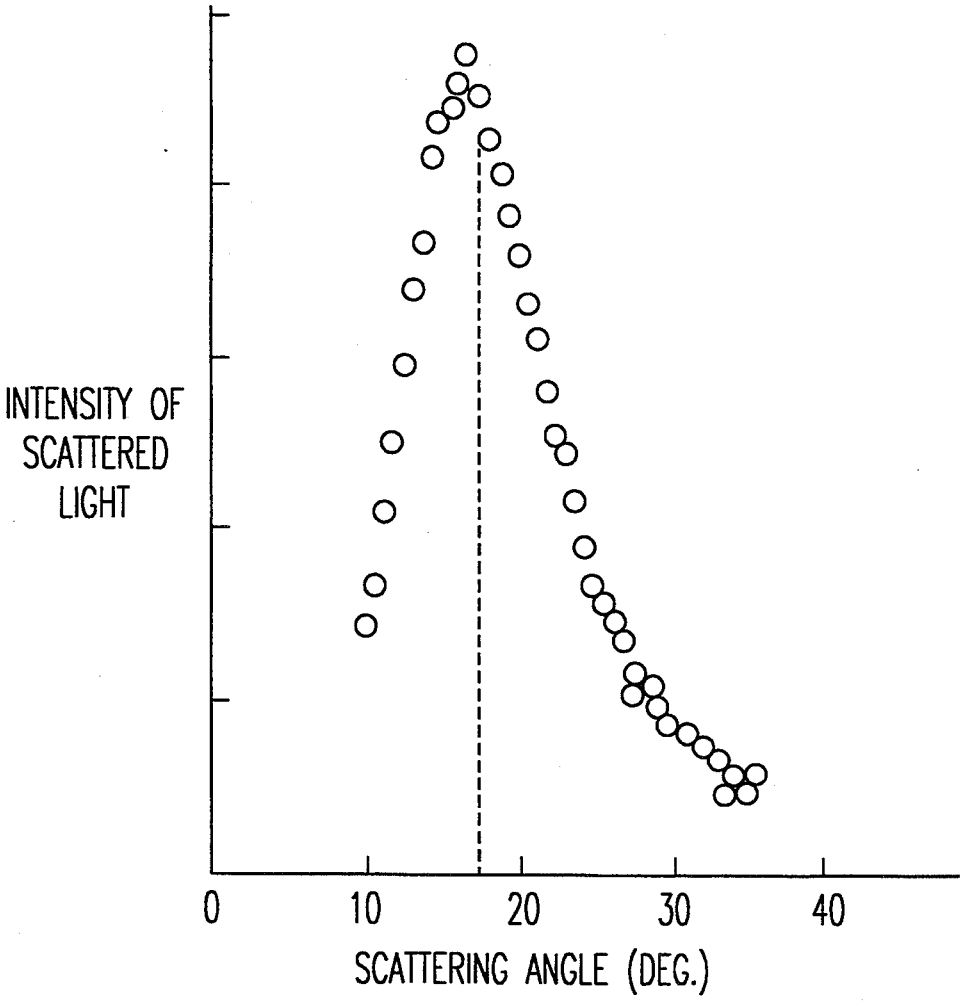
FIG. 8 is a graph which shows the relationship between the intensity of the scattered light and the scattering angle, which is obtained in Comparative Example 2.

FIGS. 6, 7, and 8 show the relationship between the scattering angle and the intensity of the scattered light obtained in Example 1, Example 3 and Comparative Example 2, respectively.

Further, each of the recording materials was heated from 52° to 132° C. stepwise with a temperature interval of 2° C., using a commercially available heat gradient tester "Type HG-100" (Trademark), made by Toyo Seiki Seisakusho, Ltd. As a portion of the recording material was heated stepwise within the range from 52° to 132° C., the image density of the portion was measured by Mcbeth densitometer RD-914, with a sheet of black paper with an optical density (O.D.) of 1.9 placed behind the recording material. The highest density of the portion in the recording layer was referred to as a transparent density, and the lowest density was referred to as a white opaque density. The results are shown in Table 1.

Figure 9:
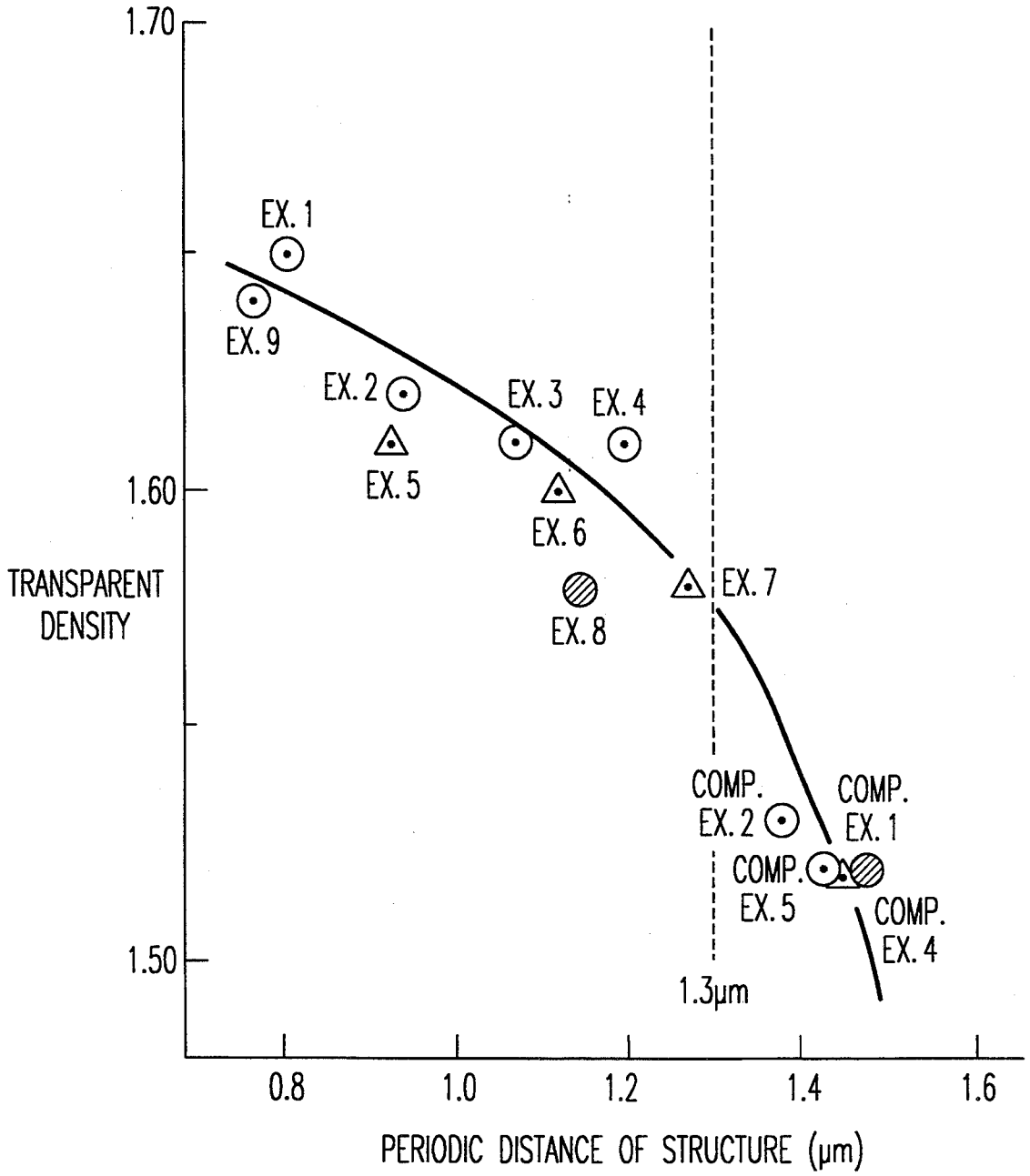
FIG. 9 is a graph which shows the relationship between the transparent density and the periodic distance of the phase-separation structure of the reversible thermosensitive recording layer.
Figure 10:
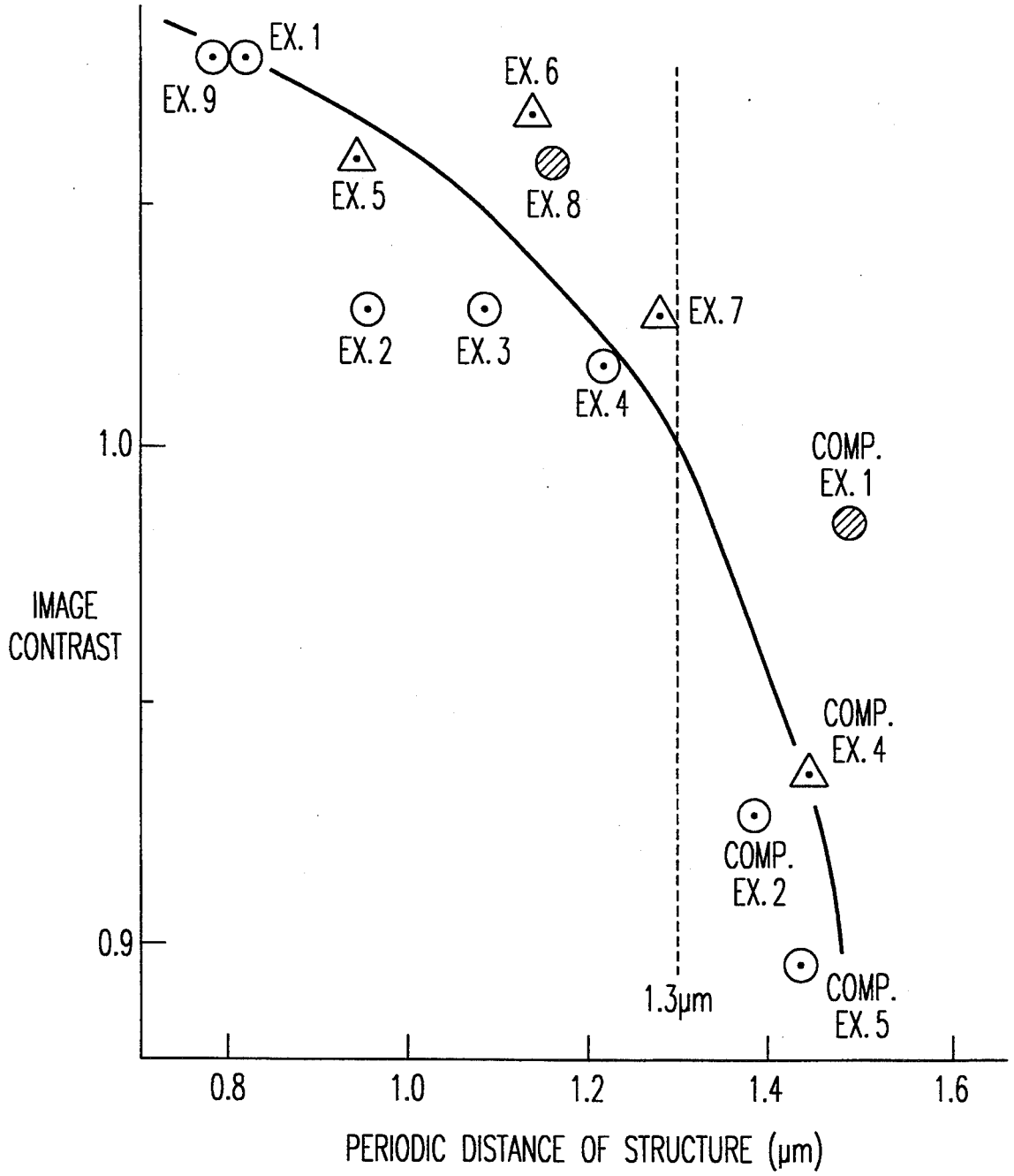
FIG. 10 is a graph which shows the relationship between the image contrast and the periodic distance of the phase-separation structure of each reversible thermosensitive recording layer.

FIG. 9 is a graph which shows the relationship between the periodic distance of the phase-separation structure of each reversible thermosensitive recording layer and the transparent density. FIG. 10 is a graph which shows the relationship between the image contrast and the periodic distance of the phase-separation structure of each reversible thermosensitive recording layer. As is apparent from the graph shown in FIG. 9, the transparent density decreases as the periodic distance of phase-separation structure of the reversible thermosensitive recording layer is increased. With respect to the recording material according to the present invention, since the periodic distance of the phase-separation structure of the reversible thermosensitive recording layer is smaller than that of the conventional thermosensitive recording layer, the transparent density is high. The white opaque density of the recording layer is not so much affected by the periodic distance of the phase-separation structure of the recording layer when the formulation of the coating liquid for the recording layer and the thickness of the obtained recording layer are the same, so that high image contrast can be obtained in the recording materials of the present invention as shown in FIG. 10.

In addition, the thermal energy was applied to each recording material to form white opaque images using a thermal head with a dot density of 8 dot/mm, and the white opaque images thus obtained was erased by use of a heat-application roller. Such an image forming and erasing operation was repeated 100 times. This image forming and erasing operation was further continued to 300 times to evaluate the durability of the recording material, using the reversible thermosensitive recording materials obtained in Examples 1, 3, 4 and 9 and Comparative Examples 2 and 5. The white opaque densities at the initial stage and after repetition of the operations 100 times and 300 times were measured by Macbeth densitometer RD-914. The results are also shown in Table 1. As can be seen from the results shown in Table 1, the change in white opaque density is small in the reversible thermosensitive recording materials according to the present invention, which proves the high durability during the repeated operations.

Figure 11:
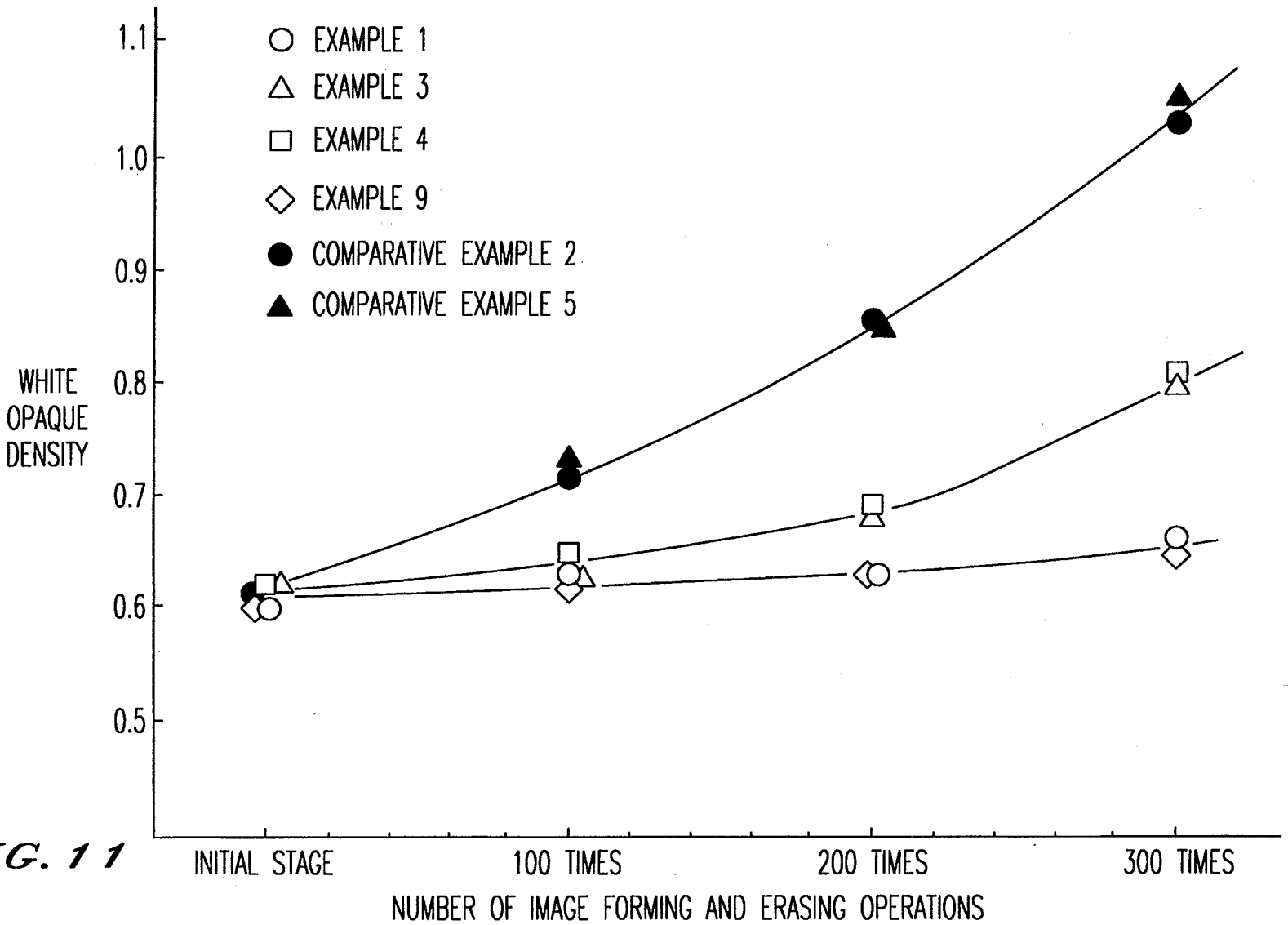
FIG. 11 is a graph which shows the relationship between the white opaque density of a milky opaque portion in the recording layer and the number of repeated image forming and erasing operations.

FIG. 11 is a graph which shows the relationship between the number of repeated image forming and erasing operations and the white opaque density of the recording layer. As is apparent from the graph in FIG. 11, the durability of the recording materials according to the present invention is excellent when the number of image forming and erasing operations exceeds 100 times.

TABLE 1

| | Light-scattering Measurement | | Heat Gradient Test | | | Durability in Repeated Operations (White opaque density) | | | | |
|---|---|---|---|---|---|---|---|---|---|---|
| | Peak value of scattering angle [°] | Periodic distance of structure [μm] | Transparent density | White opaque density | Image contrast (*) | At initial stage (A) | After 100 times (B) | After 300 times (C) | (B)-(A) | (C)-(A) |
| Ex. 1 | 30.100 | 0.810 | 1.650 | 0.570 | 1.080 | 0.600 | 0.630 | 0.660 | 0.030 | 0.060 |
| Ex. 2 | 25.600 | 0.950 | 1.620 | 0.590 | 1.030 | 0.600 | 0.620 | — | 0.020 | — |
| Ex. 3 | 22.400 | 1.080 | 1.610 | 0.580 | 1.030 | 0.610 | 0.630 | 0.800 | 0.020 | 0.170 |
| Ex. 4 | 20.000 | 1.210 | 1.610 | 0.590 | 1.020 | 0.620 | 0.650 | 0.810 | 0.030 | 0.190 |
| Ex. 5 | 25.800 | 0.940 | 1.610 | 0.550 | 1.060 | 0.540 | 0.580 | — | 0.040 | — |
| Ex. 6 | 21.500 | 1.130 | 1.600 | 0.530 | 1.070 | 0.520 | 0.550 | — | 0.030 | — |
| Ex. 7 | 18.900 | 1.280 | 1.580 | 0.550 | 1.030 | 0.560 | 0.620 | — | 0.060 | — |
| Ex. 8 | 22.000 | 1.150 | 1.580 | 0.520 | 1.060 | 0.540 | 0.580 | — | 0.040 | — |
| Ex. 9 | 31.300 | 0.780 | 1.640 | 0.560 | 1.080 | 0.600 | 0.620 | 0.650 | 0.020 | 0.050 |
| Comp. Ex. 1 | 16.400 | 1.480 | 1.520 | 0.530 | 0.990 | 0.540 | 0.640 | — | 0.100 | — |
| Comp. Ex. 2 | 17.400 | 1.380 | 1.530 | 0.600 | 0.930 | 0.610 | 0.720 | 1.030 | 0.110 | 0.420 |
| Comp. Ex. 3 | — | — | — | — | — | — | — | — | — | — |
| Comp. Ex. 4 | 16.800 | 1.440 | 1.520 | 0.560 | 0.940 | 0.570 | 0.680 | — | 0.110 | — |
| Comp. Ex. 5 | 16.900 | 1.430 | 1.520 | 0.620 | 0.900 | 0.620 | 0.730 | 1.050 | 0.110 | 0.430 |

(*)Image contrast is expressed by the difference between the transparent density and the white opaque density.

As previously explained, in the reversible thermosensitive recording material of the present invention, a reversible thermosensitive recording layer comprises a matrix resin and an organic low-molecular-weight material which is dispersed in the form of discrete domains in the matrix resin, with the periodic distance of the phase-separation structure of the reversible thermosensitive recording layer being 1.3 μm or less. Therefore, the transparent density of a transparent portion in the recording layer is remarkably high, and the durability of the recording material is excellent in the course of the repeated recording and erasing operations.

What is claimed is:

1. A reversible thermosensitive recording material comprising:

a support, and a reversible thermosensitive recording layer formed on said support, comprising a matrix resin and an organic low-molecular-weight material, said organic low-molecular-weight material being dispersed in the form of discrete domains in said matrix resin, thereby constituting a phase-separation structure, with the periodic distance of said phase-separation structure of said reversible thermosensitive recording layer being 1.3 μm or less.

2. The reversible thermosensitive recording material as claimed in claim 1, wherein said periodic distance of said phase-separation structure of said reversible thermosensitive recording layer is 1.0 μm or less.

3. The reversible thermosensitive recording material as claimed in claim 1, wherein the ratio by weight of the amount of said organic low-molecular-weight material to the amount of said matrix resin in said reversible thermosensitive recording layer is in the range from (2:1) to (1:16).

4. The reversible thermosensitive recording material as claimed in claim 3, wherein the ratio by weight of the amount of said organic low-molecular-weight material to the amount of said matrix resin in said reversible thermosensitive recording layer is in the range from (1:2) to (1:8).

* * * * *

UNITED STATES PATENT AND TRADEMARK OFFICE

CERTIFICATE OF CORRECTION

PATENT NO. : 5,342,815

DATED : August 30, 1994

INVENTOR(S) : Kunitoshi Sugiyama, et al

It is certified that error appears in the above-identified patent and that said Letters Patent is hereby corrected as shown below:

Column 18, line 42, "curng resin" should read --curing resin--

Column 18, line 57, "ComparatiVe" should read --Comparative--

Signed and Sealed this

Twenty-sixth Day of September, 1995

*Attest:*

*Attesting Officer*

Bruce Lehman

BRUCE LEHMAN

*Commissioner of Patents and Trademarks*